US007089752B2

(12) United States Patent
Jeong et al.

(10) Patent No.: US 7,089,752 B2
(45) Date of Patent: Aug. 15, 2006

(54) REFRIGERATOR AND DEFROSTING METHOD THEREOF

(75) Inventors: Seong Wook Jeong, Gwangju (KR); Jung Yeob Kim, Gwangju (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/814,796

(22) Filed: Apr. 1, 2004

(65) Prior Publication Data

US 2005/0217286 A1 Oct. 6, 2005

(30) Foreign Application Priority Data

Mar. 30, 2004 (KR) ..... 10-2004-0021494

(51) Int. Cl.
*F25D 21/06* (2006.01)

(52) U.S. Cl. ..... 62/155; 62/156

(58) Field of Classification Search ..... 62/125, 62/126, 127, 129, 130, 151, 153, 154, 155, 62/156, 128
See application file for complete search history.

(56) References Cited

U.S. PATENT DOCUMENTS 4,392,358 A 7/1983 Hicks
4,646,529 A * 3/1987 Hanson ..... 62/155
4,665,710 A * 5/1987 Kyzer et al. ..... 62/155
4,750,332 A * 6/1988 Jenski et al. ..... 62/155
5,201,185 A * 4/1993 Hanson et al. ..... 62/81
5,924,298 A * 7/1999 Yoo ..... 62/153
6,032,471 A * 3/2000 Choi ..... 62/153
6,851,270 B1 * 2/2005 Denvir ..... 62/155

* cited by examiner

*Primary Examiner*—Harry B. Tanner
(74) *Attorney, Agent, or Firm*—Staas & Halsey LLP

(57) ABSTRACT

A refrigerator and a defrosting method thereof which are capable of achieving an appropriate defrosting operation even when a part of constituent elements included in a defrosting system fails. The defrosting method includes the steps of determining whether or not a predetermined first defrosting completion condition is usable, if the predetermined first defrosting completion condition is usable, executing a first defrosting mode, which uses the predetermined first defrosting completion condition, and if the predetermined first defrosting completion condition is not usable, executing a second defrosting mode, which uses a predetermined second defrosting completion condition different from the predetermined first defrosting completion condition, and a defrosting execution determination condition different from that of the first defrosting mode.

10 Claims, 4 Drawing Sheets

REFRIGERATOR AND DEFROSTING METHOD THEREOF

CROSS-REFERENCE TO RELATED APPLICATION

This application claims the benefit of Korean Patent Application No. 2004-21494, filed on Mar. 30, 2004, in the Korean Intellectual Property Office, the disclosure of which is incorporated herein by reference.

BACKGROUND OF THE INVENTION

1. Field of the Invention

The present invention relates to a refrigerator and a defrosting method thereof, and, more particularly, to a refrigerator and a defrosting method thereof which are capable of achieving an appropriate defrosting operation even when a part of constituent elements included in a defrosting system fails.

2. Description of the Related Art

Generally, in a refrigerator, lowering of a temperature around a heat exchanger is generated due to heat absorption caused by evaporation of a liquid-state refrigerant passing through the heat exchanger. When the temperature around the heat exchanger is lowered, moisture around the heat exchanger is cooled, so that frost accumulates on the surface of the heat exchanger. The accumulated frost should be removed because it may degrade the cooling efficiency of the heat exchanger.

In order to remove frost accumulated on such a heat exchanger, conventional refrigerators are provided with a defrost heater arranged around the heat exchanger, and adapted to generate heat, and a heat exchanger temperature sensor (or defrost sensor) adapted to measure a temperature of the heat exchanger.

In such a refrigerator, a defrosting mode is periodically carried out. When the defrosting mode is to be performed, the defrost heater is turned on to generate heat. The heat generation of the defrost heater is continued until a temperature sensed by the heat exchanger temperature sensor reaches a predetermined temperature. However, where the heat exchanger temperature sensor operates erroneously due to, for example, a failure thereof, it is impossible to appropriately determine the point of time at which the defrost heater is to be turned off. In this case, the defrosting mode is not carried out, in order to prevent overheat caused by an uncontrolled operation of the defrost heater.

However, the above mentioned conventional refrigerator takes a measure to stop driving of a compressor thereof when the heat exchanger temperature sensor, in addition to the measure to prevent the defrosting mode from being carried out. For this reason, there is a problem in that food stored in the refrigerator may go bad.

SUMMARY OF THE INVENTION

Therefore, it is an aspect of the invention to provide a refrigerator and a defrosting method thereof which are capable of achieving an appropriate defrosting operation even when a part of constituent elements included in a defrosting system fails.

In accordance with one aspect, the present invention provides a defrosting method of a refrigerator comprising the steps of: determining whether or not a predetermined first defrosting completion condition is usable; if the predetermined first defrosting completion condition is usable, executing a first defrosting mode, which uses the predetermined first defrosting completion condition; and if the predetermined first defrosting completion condition is not usable, executing a second defrosting mode, which uses a predetermined second defrosting completion condition different from the predetermined first defrosting completion condition, and a defrosting execution determination condition different from that of the first defrosting mode.

The determination of whether or not the predetermined first defrosting completion condition is usable may be made, based on whether a heat exchanger temperature sensor adapted to measure a temperature of a heat exchanger, to be defrosted, is in a normal state or in a failure state.

The first defrosting mode may be executed when it is determined that the heat exchanger temperature sensor is in the normal state. The second defrosting mode may be executed when it is determined that the heat exchanger temperature sensor is in the failure state.

The step of executing the second defrosting mode may comprise the steps of, comparing a temperature of a storage compartment, to be cooled in accordance with an operation of the heat exchanger, with a reference temperature, and if the temperature of the storage compartment is lower than the reference temperature, turning on a defrost heater adapted to defrost the heat exchanger for a predetermined time.

The step of executing the second defrosting mode may further comprise the step of, if the temperature of the storage compartment is not lower than the reference temperature, preventing the defrost heater from being driven.

The second defrosting completion condition may be satisfied when a predetermined time has elapsed after the turning-on of the defrost heater.

The first defrosting completion condition may be satisfied when the temperature measured by the heat exchanger temperature sensor reaches a reference temperature.

In accordance with another aspect, the present invention provides a defrosting method of a refrigerator comprising the steps of: determining whether or not a heat exchanger temperature sensor adapted to measure a temperature of a heat exchanger, to be defrosted, is in a failure state; if the heat exchanger temperature sensor is in a failure state, comparing a temperature of a storage compartment, to be cooled in accordance with an operation of the heat exchanger, with a reference temperature; and if the temperature of the storage compartment is lower than the reference temperature, turning on a defrost heater adapted to defrost the heat exchanger for a predetermined time.

The defrosting method may further comprise the step of, if the temperature of the storage compartment is not lower than the reference temperature, preventing the defrost heater from being driven.

The failure state of the heat exchanger temperature sensor may correspond to an open-circuited or short-circuited state.

In accordance with another aspect, the present invention provides a refrigerator comprising: a heat exchanger adapted to exchange heat with air in a storage compartment; a heat exchanger temperature sensor adapted to measure a temperature of the heat exchanger; a defrost heater adapted to perform a defrosting operation for the heat exchanger; and a control unit adapted to execute a first defrosting mode when the heat exchanger temperature sensor is in a normal state, while executing a second defrosting mode, which uses a defrosting completion condition and a defrosting execution determination condition different from those of the first defrosting mode, when the heat exchanger temperature sensor is in a failure state.

The first defrosting mode may be executed to drive the defrost heater until the temperature measured by the heat exchanger temperature sensor reaches a first reference temperature. The second defrosting mode may be executed to drive the defrost heater for a predetermined time when a temperature of the storage compartment is not higher than a second reference temperature.

BRIEF DESCRIPTION OF THE DRAWINGS

The above objects, and other features and advantages of the present invention will become more apparent after reading the following detailed description when taken in conjunction with the drawings, in which.

DETAILED DESCRIPTION OF THE PREFERRED EMBODIMENTS

Figure 1:
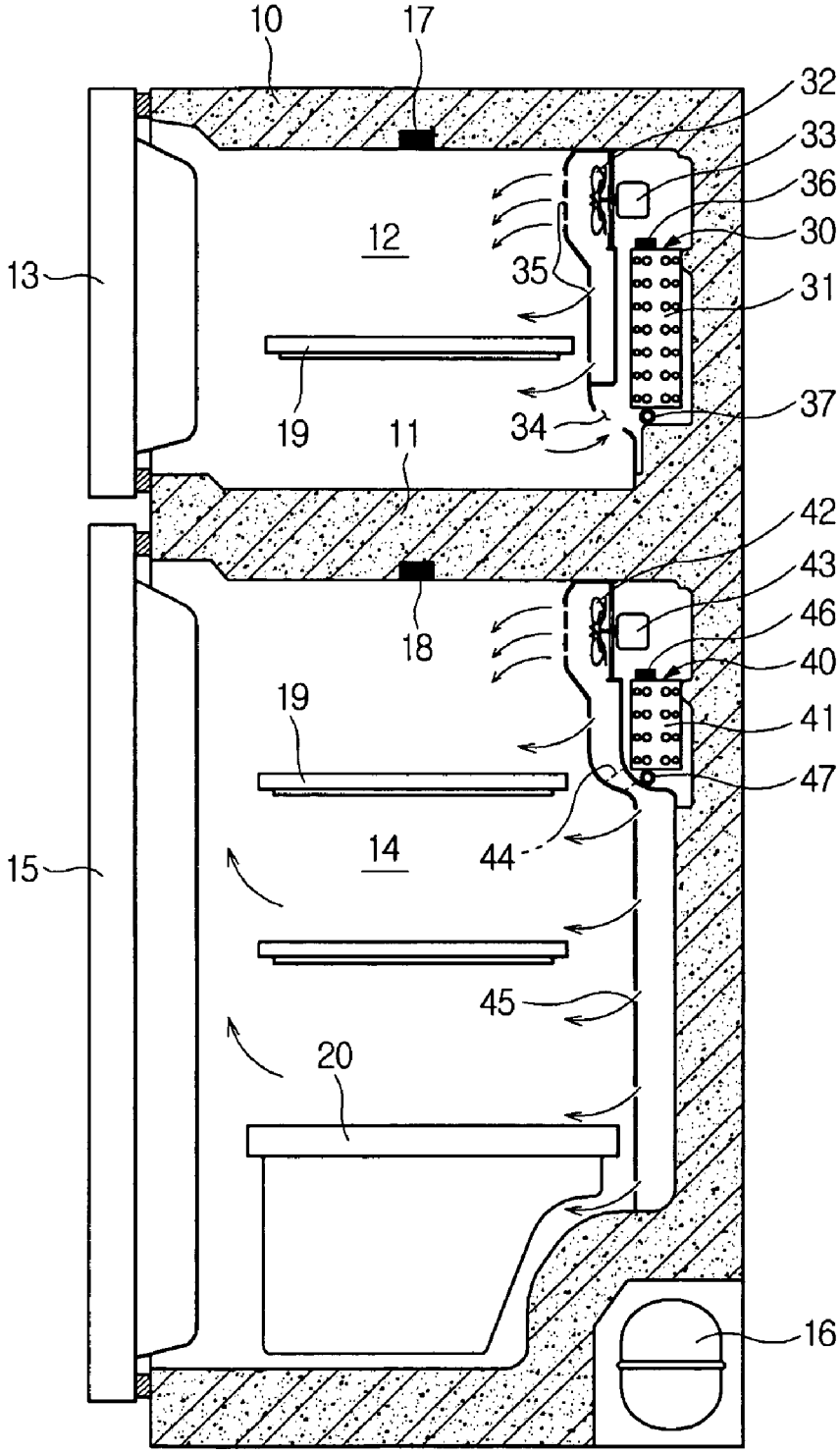
FIG. 1 is a sectional view illustrating a refrigerator according to an exemplary embodiment of the present invention.

Preferred embodiments of the present invention will now be described in detail with reference to the annexed drawings. Referring to FIG. 1, a refrigerator according to an exemplary embodiment of the present invention is illustrated. As shown in FIG. 1, the refrigerator includes a refrigerator body 10, a freezing compartment 12 defined in the refrigerator body 10 over a partition wall 11 constituting a part of the refrigerator body 10, while being opened at a front side thereof, and a freezing compartment door 13 adapted to open and close the opened front side of the freezing compartment 12. The refrigerator also includes a refrigerating compartment 14 defined in the refrigerator body 10 beneath the partition wall 11, while being opened at a front side thereof, a refrigerating compartment door 15 adapted to open and close the opened front side of the refrigerating compartment 14, and a compressor 16 arranged at a lower rear portion of the refrigerator body 10.

A freezing compartment heat exchanging device 30 is arranged between a rear wall of the freezing compartment 12 and a wall portion of the refrigerator body 10 facing the rear wall of the freezing compartment 12, in order to perform a heat exchanging operation for the freezing compartment 12. Similarly, a refrigerating compartment heat exchanging device 40 is arranged between a rear wall of the refrigerating compartment 14 and a wall portion of the refrigerator body 10 facing the rear wall of the refrigerating compartment 14, in order to perform a heat exchanging operation for the refrigerating compartment 14. A freezing compartment temperature sensor 17 and a refrigerating compartment temperature sensor 18 are provided at desired wall portions of the freezing and refrigerating compartments 12 and 14, respectively. Shelves 19 and storage containers 20 are arranged in the freezing and refrigerating compartments 12 and 14 to store food.

The freezing compartment heat exchanging device 30 includes a freezing compartment heat exchanger 31 adapted to cool air in the freezing compartment 12 in accordance with a heat exchanging operation thereof, a freezing compartment fan 32 arranged over the freezing compartment heat exchanger 31 to circulate, through the freezing compartment 12, air cooled while passing the freezing compartment heat exchanger 31, and a freezing compartment fan motor 33 adapted to drive the freezing compartment fan 32. A suction hole 34 is formed at the rear wall of the freezing compartment 12 beneath the freezing compartment heat exchanger 31 to suck air from the freezing compartment 12 toward the freezing compartment heat exchanger 31 in accordance with operation of the freezing compartment fan 32. At the rear wall of the freezing compartment 12, a plurality of discharge holes 35 are formed to uniformly discharge cold air blown by the freezing compartment fan 32 into the freezing compartment 12.

A first heat exchanger temperature sensor 36 is arranged above the freezing compartment heat exchanger 31 to measure a temperature of the freezing compartment heat exchanger 31. For the first heat exchanger temperature sensor 36, a negative temperature coefficient (NTC) themistor may be used.

The NTC thermistor, which has a negative temperature coefficient, exhibits a decreased resistance when the temperature of a space where the NTC thermistor is installed increases, while exhibiting an increased resistance when the temperature of the space decreases. Accordingly, after the resistance of the NTC thermistor is measured, it is possible to identify the temperature of the space where the NTC thermistor is installed, using a relation between the resistance of the NTC thermistor and the temperature of the space.

A first defrost heater 37 is provided at the freezing compartment heat exchanger 31 such that it extends along the bottom and one side of the freezing compartment heat exchanger 31. The first defrost heater 37 comprises an electric heating wire adapted to generate heat when current is supplied thereto.

The refrigerating compartment heat exchanging device 40 has a configuration similar to that of the freezing compartment heat exchanging device 30. That is, the refrigerating compartment heat exchanging device 40 includes a refrigerating compartment heat exchanger 41 adapted to cool air in the refrigerating compartment 14 in accordance with a heat exchanging operation thereof, a refrigerating compartment fan 42 arranged over the refrigerating compartment heat exchanger 41 to circulate, through the refrigerating compartment 14, air cooled while passing the refrigerating compartment heat exchanger 41, and a refrigerating compartment fan motor 43 adapted to drive the refrigerating compartment fan 42. A suction hole 44 is formed at the rear wall of the refrigerating compartment 14 beneath the refrigerating compartment heat exchanger 41 to suck air from the refrigerating compartment 14 toward the refrigerating compartment heat exchanger 41 in accordance with operation of the refrigerating compartment fan 42. At the rear wall of the refrigerating compartment 14, a plurality of discharge holes 45 are formed to uniformly discharge cold air blown by the refrigerating compartment fan 42 into the refrigerating compartment 14.

A second heat exchanger temperature sensor 46 is arranged above the refrigerating compartment heat exchanger 41 to measure a temperature of the refrigerating compartment heat exchanger 41. For the second heat exchanger temperature sensor 46, an NTC themistor may be used, as in the case of the first heat exchanger temperature sensor 36.

A second defrost heater 47 is provided at the refrigerating compartment heat exchanger 41 such that it extends along the bottom and one side of the refrigerating compartment heat exchanger 41. The second defrost heater 47 comprises an electric heating wire adapted to generate heat when current is supplied thereto.

Figure 2:
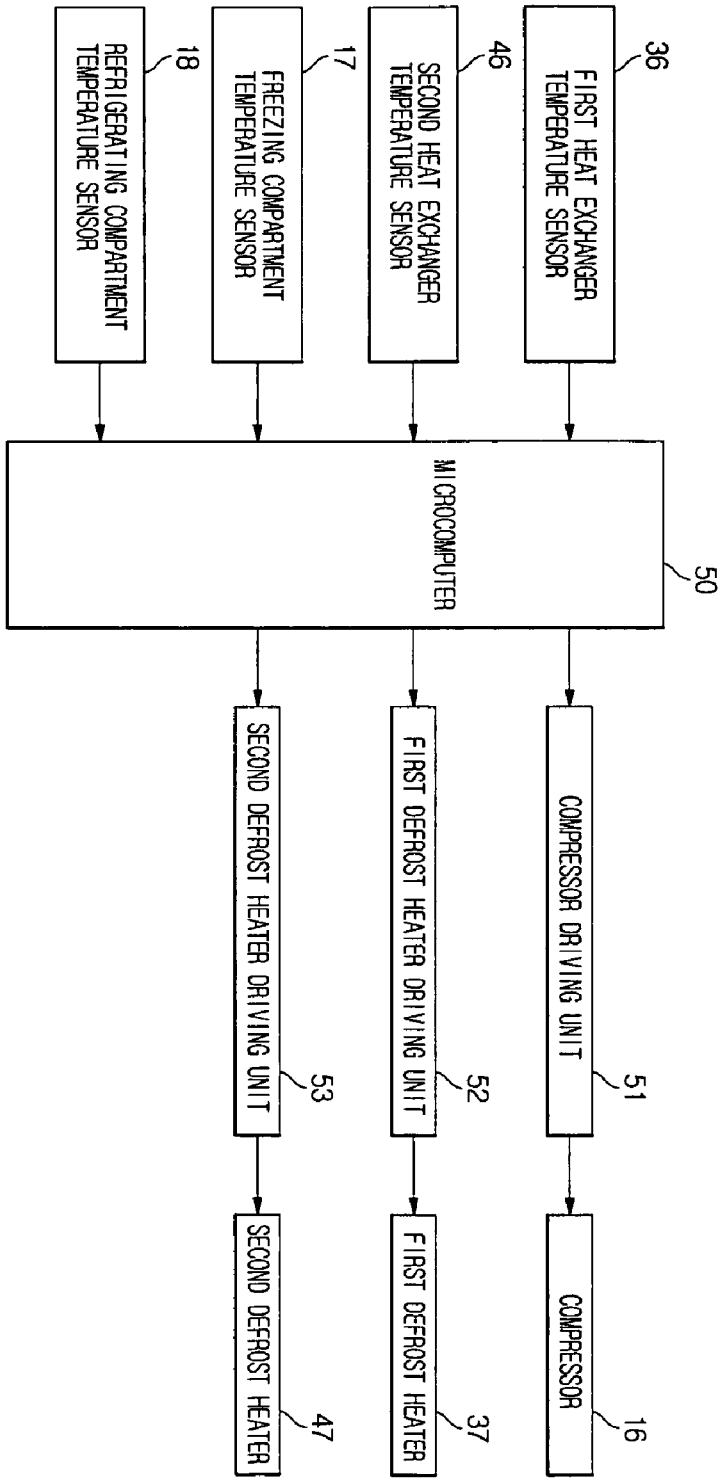
FIG. 2 is a block diagram illustrating a configuration of the refrigerator illustrated in FIG. 1.

As shown in FIG. 2, the refrigerator, which has the configuration shown in FIG. 1, also includes a compressor driving unit 51 adapted to drive the compressor 16, a first defrost heater driving unit 52 adapted to drive the first defrost heater 37, a second defrost heater driving unit 53 adapted to drive the second defrost heater 47, and a microcomputer 50 adapted to control the entire operation of the refrigerator.

Figure 3:
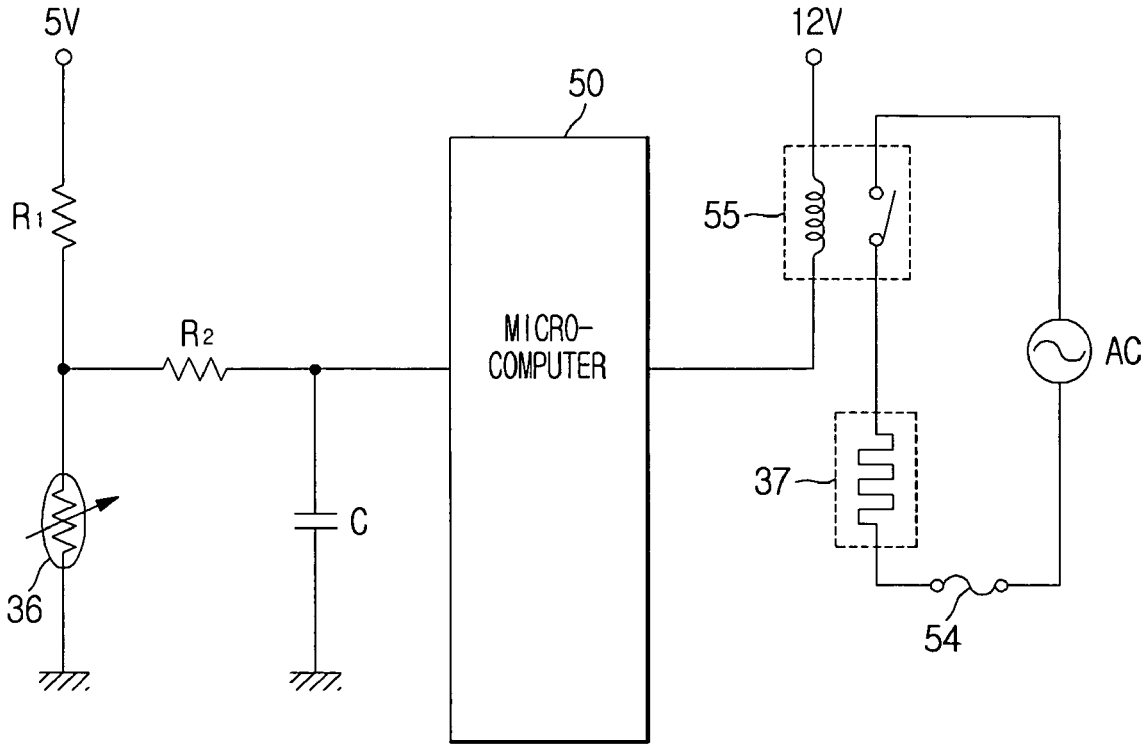
FIG. 3 is a circuit diagram illustrating a first heat exchanger temperature sensor and a first defrost heater included in the refrigerator of FIG. 2.

As shown in FIG. 3, the NTC thermistor used as the first heat exchanger temperature sensor 36 is connected to a voltage dividing resistor R1 adapted to divide a voltage supplied from a 5V constant voltage source. The NTC thermistor is also connected to a current limit resistor R2 adapted to limit current supplied to the microcomputer 50. A capacitor C is coupled between the current limit resistor R2 and the microcomputer 50 to remove noise components from a voltage signal inputted to the microcomputer 50.

Meanwhile, the first defrost heater 37, which comprises an electric heating wire, is connected to a thermal fuse 54. The thermal fuse 54 is connected between a voltage source AC and the first defrost heater 37 to prevent the first defrost heater 37 from being damaged due to overcurrent from the voltage source AC. The first defrost heater 37 is also connected to a relay 55. The relay 55 connects or disconnects the first defrost heater 37 to or from the voltage source AC in accordance with a control signal from the microcomputer 50.

In this defrosting system, the temperature of the freezing compartment heat exchanger 31 may vary during an operation of the refrigerator. Such a variation in the temperature of the freezing compartment heat exchanger 31 causes a variation in the resistance of the first heat exchanger temperature sensor 36. Accordingly, where the first heat exchanger temperature sensor 36 operates normally, it must output voltages of diverse levels to the microcomputer 50.

However, where the first heat exchanger temperature sensor 36 is in an open-circuited state, 5V is always inputted to an input port of the microcomputer 50 connected to the first heat exchanger temperature sensor 36, irrespective of the actual temperature of the freezing compartment heat exchanger 31. On the other hand, where the first heat exchanger temperature sensor 36 is in a short-circuited state, 0V is always inputted to the input port of the microcomputer 50 connected to the first heat exchanger temperature sensor 36, irrespective of the actual temperature of the freezing compartment heat exchanger 31. Accordingly, the microcomputer 50 can determine, based on the level of the voltage inputted thereto from the first heat exchanger temperature sensor 36, whether the first heat exchanger temperature sensor 36 operates normally or fails due to open-circuit or short-circuit thereof.

Although only the first defrost heater 37 and first heat exchanger temperature sensor 36 associated with a defrosting operation for the freezing compartment heat exchanger 31 have been described with reference to FIG. 3, the same description may be given of the second defrost heater 47 and second heat exchanger temperature sensor 46 associated with a defrosting operation for the refrigerating compartment heat exchanger 41.

Figure 4:
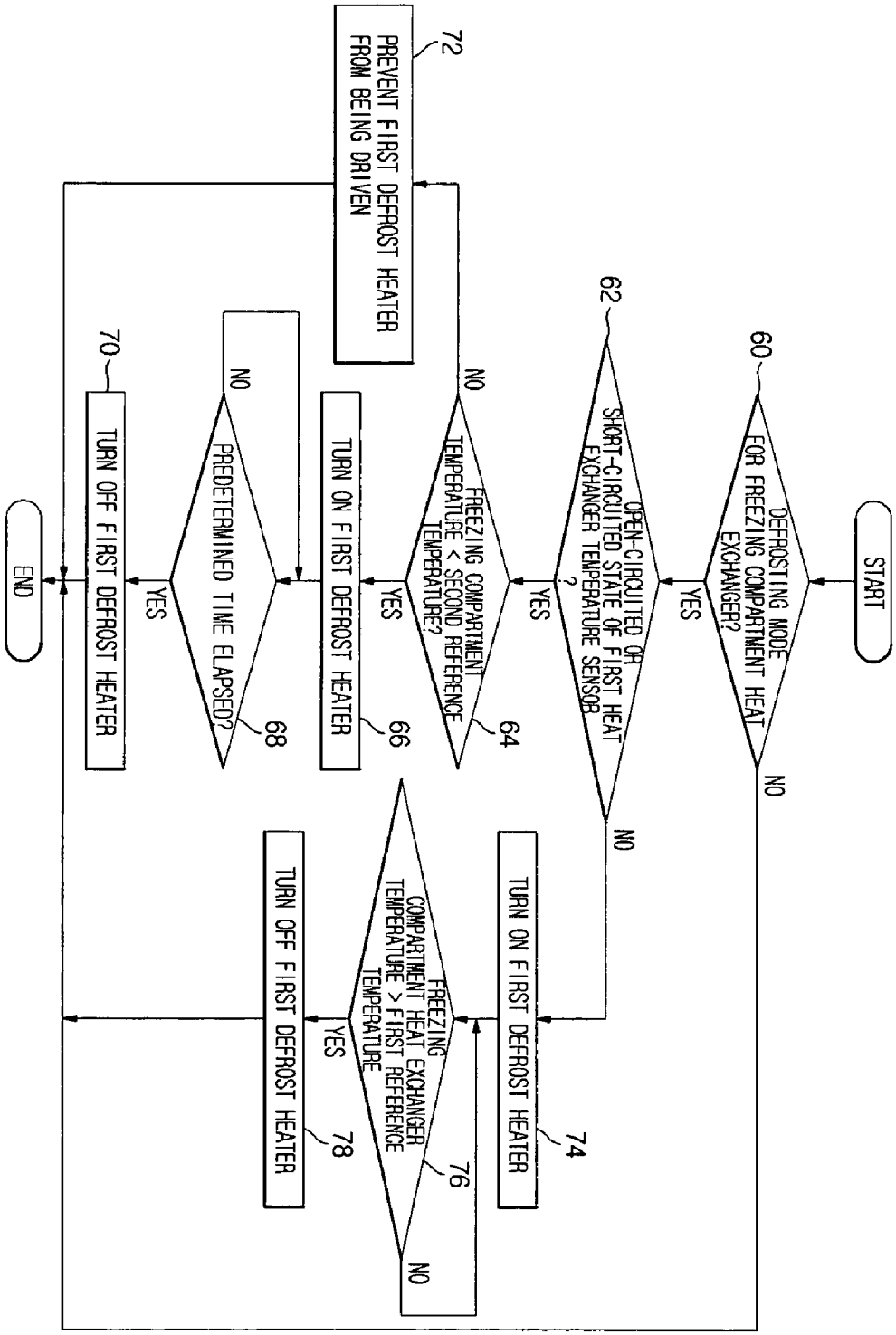
FIG. 4 is a flow chart illustrating an operation of the refrigerator illustrated in FIG. 2.

Now, the operation of the refrigerator shown in FIG. 2 will be described with reference to FIG. 4. In accordance with the present invention, the microcomputer 50 first determines whether or not the current operation mode of the refrigerator is a defrosting mode for the freezing compartment heat exchanger 31 (Step 60). Here, the defrosting mode is a mode for removing frost accumulated on the heat exchanger. In accordance with the illustrated embodiment of the present invention, the defrosting mode is executed at intervals of a predetermined time (for example, at intervals of 3 hours during the operation of the refrigerator).

When it is determined that the current operation mode of the refrigerator is not the defrosting mode, the microcomputer 50 completes a control cycle for the defrosting mode. On the other hand, where the current operation mode is the defrosting mode, the microcomputer 50 determines, based on an input voltage from the first heat exchanger temperature sensor 36, whether the first heat exchanger temperature sensor 36 is in a normal state or a failure or abnormal state, for example, an open-circuited or short-circuited state (Step 62). The reason why it is determined whether or not the first heat exchanger temperature sensor 36 is in a normal state is that it is necessary to determine whether a desired defrosting operation is to be carried out in a first defrosting mode, to be described hereinafter, or in a second defrosting mode. If there is an abnormality in the first heat exchanger temperature sensor 36, it is impossible to appropriately determine the point of time, at which the defrosting operation is to be completed, in association with the first defrosting mode. In this case, accordingly, it is undesirable to use the first defrosting mode. The second defrosting mode is proper in this case.

Where the first heat exchanger temperature sensor 36 is normal, the microcomputer 50 performs a control operation associated with a defrosting operation in the first defrosting mode. That is, the microcomputer 50 sends a control signal to the first defrost heater driving unit 52 to turn on the first defrost heater 37 (Step 74). The microcomputer 50 then determines whether or not a temperature of the freezing compartment heat exchanger 31 measured by the first heat exchanger temperature sensor 36 is higher than a first reference temperature (Step 76). The first reference temperature is a temperature at which frost accumulated on the freezing compartment heat exchanger 31 is sufficiently removable. This temperature may be experimentally determined.

When it is determined that the measured temperature of the freezing compartment heat exchanger 31 is not higher than the first reference temperature, the microcomputer 50 determines that the sufficient defrosting has not been achieved yet. Accordingly, the microcomputer 50 controls the first defrost heater 37 to be continuously driven. On the other hand, when it is determined that the measured temperature of the freezing compartment heat exchanger 31 is higher than the first reference temperature, the microcomputer 50 sends a control signal to the first defrost heater driving unit 52 to turn off the first defrost heater 37 (Step 78).

On the other hand, where it is determined at step 62 that the first heat exchanger temperature sensor 36 is abnormal, the microcomputer 50 performs a control operation associated with a defrosting operation in the second defrosting mode. In this case, the microcomputer 50 first determines whether or not a temperature of the freezing compartment 12 measured by the freezing compartment temperature sensor 17 is lower than a second reference temperature (Step 64).

The second reference temperature is a reference temperature for determining whether or not the compressor 16 and freezing compartment fan 32 operate normally. This temperature is set by a maximum temperature of the freezing compartment 12 available when both the compressor 16 and the freezing compartment fan 32 operate normally. For example, where it is assumed that the maximum temperature of the freezing compartment 12 available when both the compressor 16 and the freezing compartment fan 32 operate normally is −2° C., the second reference temperature corresponds to −2° C. The second reference temperature may be experimentally determined.

When it is determined that the measured freezing compartment temperature is higher than the second reference temperature, the microcomputer 50 determines that there is an abnormality in the compressor 16 or freezing compartment fan 32. In this case, accordingly, the microcomputer 50 prevents the first defrost heater 37 from being driven (Step 72). When the defrosting mode is executed in the case in which the temperature of the freezing compartment heat exchanger 32 has already been increased due to an abnormal operation of the compressor 16 or freezing compartment fan 32, the freezing compartment heat exchanger 32 and peripheral devices may be damaged due to heat generated from the first defrost heater 37. In this case, accordingly, the microcomputer 50 prevents the first defrost heater 37 from being driven.

On the other hand, where the measured freezing compartment temperature is not higher than the second reference temperature, the microcomputer 50 sends a control signal to the first defrost heater driving unit 52 to turn on the first defrost heater 37 (Step 66). Thereafter, the microcomputer 50 determines whether or not a predetermined time has elapsed (Step 68). The predetermined time is a time for which the first defrost heater 37 is to be driven. This time is set by a time capable of achieving sufficient defrosting.

When it is determined that the driving time of the first defrost heater 37 has not reached the predetermined time yet, the microcomputer 50 returns the control operation thereof to step 68. On the other hand, where the driving time of the first defrost heater 37 has reached the predetermined time, the microcomputer 50 sends a control signal to the first defrost heater driving unit 52 to turn off the first defrost heater 37 (Step 70).

The operations of the second defrost heater 47 and second heat exchanger temperature sensor 46 associated with a defrosting operation for the refrigerating compartment heat exchanger 41 are carried out in the same manner as described above.

As apparent from the above description, in accordance with the present invention, it is possible to achieve an appropriate defrosting operation even when a part of constituent elements included in the defrosting system fails.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

The invention claimed is:

1. A defrosting method of a refrigerator comprising the steps of:

checking whether a heat exchanger temperature sensor adapted to measure a temperature of a heat exchanger, to be defrosted, is in a normal state or in a failure state;

executing a first defrosting mode according to a first defrosting condition when it is determined that the heat exchanger temperature sensor is in the normal state; and executing a second defrosting mode according to a second defrosting condition when it is determined that the heat exchanger temperature sensor is in the failure state;

wherein the step of executing the second defrosting mode comprises the steps of:

comparing a temperature of a storage compartment, to be cooled in accordance with an operation of the heat exchanger, with a reference temperature; and if the temperature of the storage compartment is lower than the reference temperature, determining that a compressor and a storage compartment fan operate normally, and turning on a defrost heater adapted to defrost the heat exchanger for a predetermined time for a defrosting operation.

2. The defrosting method according to claim 1, wherein the step of executing the second defrosting mode further comprises the step of:

if the temperature of the storage compartment is not lower than the reference temperature, determining that at least one of the compressor and the storage compartment fan operates abnormally, and preventing the defrost heater from being driven to prevent the defrosting operation from being executed.

3. The defrosting method according to claim 1, wherein:

the reference temperature is set by a maximum temperature of the storage compartment available when the compressor and the storage compartment fan operate normally.

4. A defrosting method of a refrigerator comprising the steps of:

determining whether or not a heat exchanger temperature sensor adapted to measure a temperature of a heat exchanger, to be defrosted, is in a failure state;

if the heat exchanger temperature sensor is in a failure state, comparing a temperature of a storage compartment, to be cooled in accordance with an operation of the heat exchanger, with a reference temperature; and if the temperature of the storage compartment is lower than the reference temperature, determining that a compressor and the storage compartment fan operate normally, and turning on a defrost heater adapted to defrost the heat exchanger for a predetermined time for a defrosting operation.

5. The defrosting method according to claim 4, further comprising the step of:

if the temperature of the storage compartment is not lower than the reference temperature, determining that the compressor and the storage compartment fan operate abnormally, and preventing the defrost heater from being driven to prevent the defrosting operation from being executed.

6. The defrosting method according to claim 4, wherein the failure state of the heat exchanger temperature sensor corresponds to an open-circuited or short-circuited state.

7. A refrigerator comprising:

a heat exchanger adapted to exchange heat with air in a storage compartment;

a heat exchanger temperature sensor adapted to measure a temperature of the heat exchanger;

a defrost heater adapted to perform a defrosting operation for the heat exchanger; and a control unit adapted to execute a first defrosting mode for a defrosting time determined in accordance with a detection value of the heat exchanger temperature sensor when the heat exchanger temperature sensor is in a normal state, while executing a second defrosting mode for a defrosting time limited to a predetermined time, when the heat exchanger temperature sensor is in a failure state, wherein the control unit determines that a compressor and a storage compartment fan operate normally, when a temperature of the storage compartment is lower than a second reference temperature, and executes the second defrosting mode, based on the determination.

8. The refrigerator according to claim 7, wherein:

the first defrosting mode is executed to drive the defrost heater until the temperature measured by the heat exchanger temperature sensor reaches a first reference temperature.

9. A defrosting method of a refrigerator comprising the steps of:

checking whether a heat exchanger temperature sensor adapted to measure a temperature of a heat exchanger, to be defrosted, is in a normal state or in a failure state;

executing a first defrosting mode according to a first defrosting condition when it is determined that the heat exchanger temperature sensor is in the normal state; and executing a second defrosting mode according to a second defrosting condition when it is determined that the heat exchanger sensor is in the failure state;

wherein the step of executing the second defrosting mode comprises the steps of:

comparing a temperature of a storage compartment, to be cooled in accordance with an operation of the heat exchanger, with a reference temperature; and if the temperature of the storage compartment is higher than the reference temperature, determining that at least one of a compressor and a storage compartment fan operates abnormally, and preventing a defrost heater adapted to defrost the heat exchanger from being driven to prevent a defrosting operation from being executed.

10. The defrosting method according to claim 9, wherein the reference temperature is set by a maximum temperature of the storage compartment available when the compressor and the storage compartment fan operate normally.

* * * * *